US006368234B1

(12) United States Patent
Galloway

(10) Patent No.: US 6,368,234 B1
(45) Date of Patent: Apr. 9, 2002

(54) GOLF CLUB STRIKING PLATE HAVING ELLIPTICAL REGIONS OF THICKNESS

(75) Inventor: J. Andrew Galloway, Escondido, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 09/481,167

(22) Filed: Jan. 12, 2000

Related U.S. Application Data

(63) Continuation-in-part of application No. 09/431,982, filed on Nov. 1, 1999.

(51) Int. Cl.[7] ..... A63B 53/04; A63B 53/06

(52) U.S. Cl. ..... 473/349; 473/345; 473/324

(58) Field of Search ..... 473/342, 345, 473/332, 346, 349, 290, 291, 329, 350

(56) References Cited

U.S. PATENT DOCUMENTS

| | | | | |
|---|---|---|---|---|
| 4,687,205 | A | | 8/1987 | Tominaga et al. |
| 5,172,913 | A | | 12/1992 | Bouquet |
| 5,261,663 | A | | 11/1993 | Anderson |
| 5,261,664 | A | | 11/1993 | Anderson |
| 5,272,802 | A | | 12/1993 | Stites, III |
| 5,344,140 | A | | 9/1994 | Anderson |
| 5,346,217 | A | | 9/1994 | Tsuchiya et al. |
| 5,429,357 | A | | 7/1995 | Kobayashi |
| 5,451,056 | A | * | 9/1995 | Manning ..... 273/167 F |
| 5,460,371 | A | | 10/1995 | Takeda |
| 5,464,216 | A | | 11/1995 | Hoshi et al. |
| 5,485,998 | A | | 1/1996 | Kobayashi |
| 5,501,459 | A | | 3/1996 | Endo |
| 5,527,034 | A | | 6/1996 | Ashcraft et al. |
| 5,556,097 | A | | 9/1996 | Endo et al. |
| 5,676,605 | A | * | 10/1997 | Kobayashi ..... 473/331 |
| 5,776,011 | A | | 7/1998 | Su et al. |
| 5,788,584 | A | | 8/1998 | Parente et al. |
| 5,797,807 | A | | 8/1998 | Moore |
| 5,830,084 | A | * | 11/1998 | Kosmatka ..... 473/349 |

FOREIGN PATENT DOCUMENTS

| | | |
|---|---|---|
| JP | 05116557 | 4/1993 |
| JP | 07216213 | 8/1995 |
| JP | 09235312 | 7/1997 |
| JP | 10028281 | 2/1998 |

* cited by examiner

*Primary Examiner*—Paul T. Sewell
*Assistant Examiner*—Sneh Vaua
(74) *Attorney, Agent, or Firm*—Michael A. Catania

(57) ABSTRACT

A golf club head having a striking plate with concentric elliptical regions of varying thickness ranges is disclosed herein. A central elliptical region has a base thickness range that is thicker than the thickness range of any of the other elliptical regions. The thickness of the elliptical regions decreases outward from the center. The striking plate may be used on a wood-type golf club head or an iron-type golf club head. The striking plate is preferably composed of steel or titanium. The elliptical regions correspond to golf ball impact probability points on the striking plate.

8 Claims, 4 Drawing Sheets

GOLF CLUB STRIKING PLATE HAVING ELLIPTICAL REGIONS OF THICKNESS

CROSS REFERENCES TO RELATED APPLICATIONS

The present application is a continuation-in-part application of co-pending U.S. patent application Ser. No. 09/431,982, which was filed on Nov. 1, 1999.

STATEMENT REGARDING FEDERALLY SPONSORED RESEARCH OR DEVELOPMENT

Not Applicable

BACKGROUND OF THE INVENTION

1. Field of the Invention

The present invention relates to a golf club striking plate. More specifically, the present invention relates to a golf ball striking plate having a variable thickness.

2. Description of the Related Art

Present golf clubs have repositioned weight in order to lower the center of gravity for better performance. This repositioning of weight has for the most part attempted to thin the crown and striking plate of the golf club while precisely placing the weight in the sole of the golf club. However, thinning the striking plate too much may lead to failure of the golf club.

When the striking plate impacts a golf ball during a swing, large impact forces (in excess of 2000 pounds) are produced thereby loading the striking plate. In the relatively thin striking plates of hollow metal woods and cavity-back irons, these forces tend to produce large internal stresses in the striking plate. These internal stresses often cause catastrophic material cracking which leads to failure of the club head.

Computational and experimental studies on hollow metal woods and cavity-backed irons have demonstrated that such catastrophic material cracking most often occurs at impact points on the striking plate. These impact points require added strength to prevent club head failure.

In designing golf club heads, the striking plate must be structurally adequate to withstand large repeated forces such as those associated with impacting a golf ball at high speeds. Such structural adequacy may be achieved by increasing the striking plate stiffness so that the stress levels are below the critical stress. levels of the material used in the striking plate. Typically, for metal woods, the striking plates are stiffened by uniformly increasing the thickness of the striking plate and/or by adding one or more ribs to the interior surface of the striking plate.

Uniformly increasing the thickness of the striking plate portion typically requires the addition of large amounts of material to adequately reduce the stress sufficient to prevent impact and/or fatigue cracking. However, the addition of such a large amount of material to a striking plate generally adversely affects the performance of the golf club.

One of the first patents to disclose variable face thickness was U.S. Pat. No. 5,318,300 to Schmidt et al., for a Metal Wood Golf Club With Variable Faceplate Thickness which was filed on Nov. 2, 1992. Schmidt et al discloses thickening the faceplate to prevent cracking.

A more further disclosure of variable face thickness is disclosed in U.S. Pat. No. 5,830,084 to Kosmatka for a Contoured Golf Club Face which was filed on Oct. 23, 1996. Kosmatka addresses contouring the face to thicken certain regions while thinning other regions depending on the stress load experienced by such regions. Kosmatka also discloses a method for designing a face plate according to measured stress levels experienced during impact with a golf ball. Kosmatka, U.S. Pat. No. 5,971,868 for a Contoured Back Surface Of Golf Club Face, filed on Nov. 18, 1997, discloses similar contouring for an iron.

A more recent disclosure is Noble et al., U.S. Pat. No. 5,954,596, for a Golf Club Head With Reinforced Front Wall, which was filed on Dec. 4, 1997. Noble et al. discloses a face plate with the thickness portion at the geometric center, and gradually decreasing toward the top and bottom, and the sole and heel. The top and bottom ends along a line through geometric center have the same thickness, and the heel and sole ends along a line through geometric center have the same thickness.

Other references make partial disclosure of varying face thickness. One example is FIG. 8 of U.S. Pat. No. 5,505,453 which illustrates an interior surface of a face with a bulging center and decreasing thickness towards the heel and sole ends, similar to Noble et al. Another example is FIGS. 4C and 4D of U.S. Pat. No. 5,346,216 which discloses a bulging center that decreases in thickness toward the heel and sole ends, and the top and bottom end of the face, similar to Noble et al. However, the prior art has failed to design a striking plate or face plate that varies the thickness according to predicted golf ball impact points on the striking plate.

BRIEF SUMMARY OF THE INVENTION

The present invention is directed at a striking plate for a golf club head that is contoured according to the probability of impact with a golf ball in order to lessen the overall thickness of the striking plate, and thus lessen the weight of the golf club head. Further, the striking plate has elliptical regions of varying thickness that allows for more compliance during impact with a golf ball.

One aspect of the present invention is a golf club head having a body with a crown, a sole, a heel end, a toe end and a striking plate. The striking plate has a plurality of elliptical regions of varying thickness. A central elliptical region has a base thickness. A first concentric elliptical region encompassing the central elliptical region and has a first thickness that is thinner than the base thickness. A second concentric elliptical region has a second thickness that is thinner than the first thickness. A third concentric region has a third thickness that is thinner than the second thickness.

The central elliptical region may have a thickness of at least 0.110 inches. Alternatively, the central elliptical region may have a thickness of less than 0.125 inches. The striking plate may be composed of a material selected from the group consisting of titanium, titanium alloys, steels, vitreous metals, ceramics, composites, carbon materials, carbon fiber materials, other fibrous materials and mixtures thereof. The central elliptical region and each of the plurality of concentric elliptical regions may have a thickness range of 0.005 inches wherein the central elliptical region has a thickness range of 0.115 to 0.110 inches and the first concentric elliptical region of the plurality of concentric elliptical regions has a thickness range of 0.110 to 0.105 inches.

The striking plate may further includes heel and toe regions outside the circumference of the plurality of elliptical regions. A first heel end region and a first toe end region may each have a fourth thickness range that is less than the third thickness range. A second heel end region and a second toe end region may have a fifth thickness range that is less than the fourth thickness range. A third toe end region may have a sixth thickness range that is less than the fifth thickness range and a third heel end region may have a seventh thickness range that is greater than the base thickness. The third heel region is adjacent the heel end of the golf club head, and the third toe region is adjacent the toe end of the golf club head. The first and second heel and toe regions are intermediate the third toe and heel regions and the plurality of elliptical regions.

Another aspect of the present invention is a striking plate having a central elliptical region and plurality of concentric elliptical regions encompassing the central elliptical region. Each of the plurality of concentric elliptical regions has a thickness range that is thinner than the thickness range of the central elliptical region. The central elliptical region and each of the plurality of concentric elliptical regions may be angled downward toward the heel end of the sole.

Another aspect of the present invention is a striking plate having a plurality of elliptical regions. Each of the plurality of elliptical regions having a thickness range that is different than the other plurality of elliptical regions wherein the elliptical regions are designed to correspond in thickness to points on the striking plate having the highest probability of impact with a golf ball. Yet another aspect of the present invention is a method for designing a striking plate for a golf club head. The method includes assigning elliptical regions of varying thickness to areas of the striking plate according to the probability of impacts with a golf ball wherein the elliptical region with the highest probability of impacts with a golf ball is the thickest portion of the elliptical regions of the striking plate.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
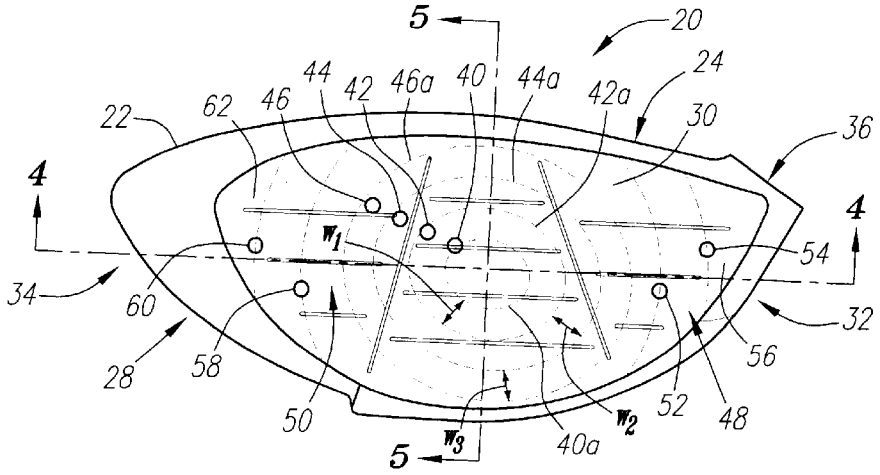
FIG. 1 is a front plan view of a golf club head with the striking plate of the present invention.
Figure 2:
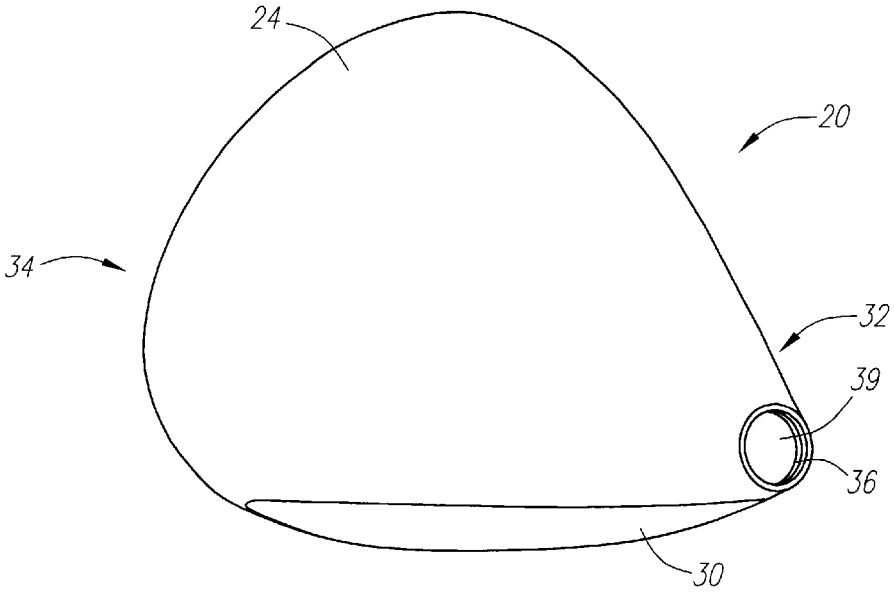
FIG. 2 is a top view of the golf club head of FIG. 1.
Figure 3:
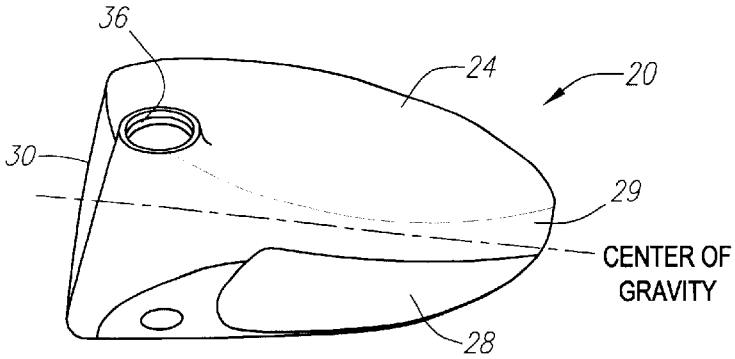
FIG. 3 is a side view of the golf club head of FIG. 1 illustrating the center of gravity of the golf club head.
Figure 4:
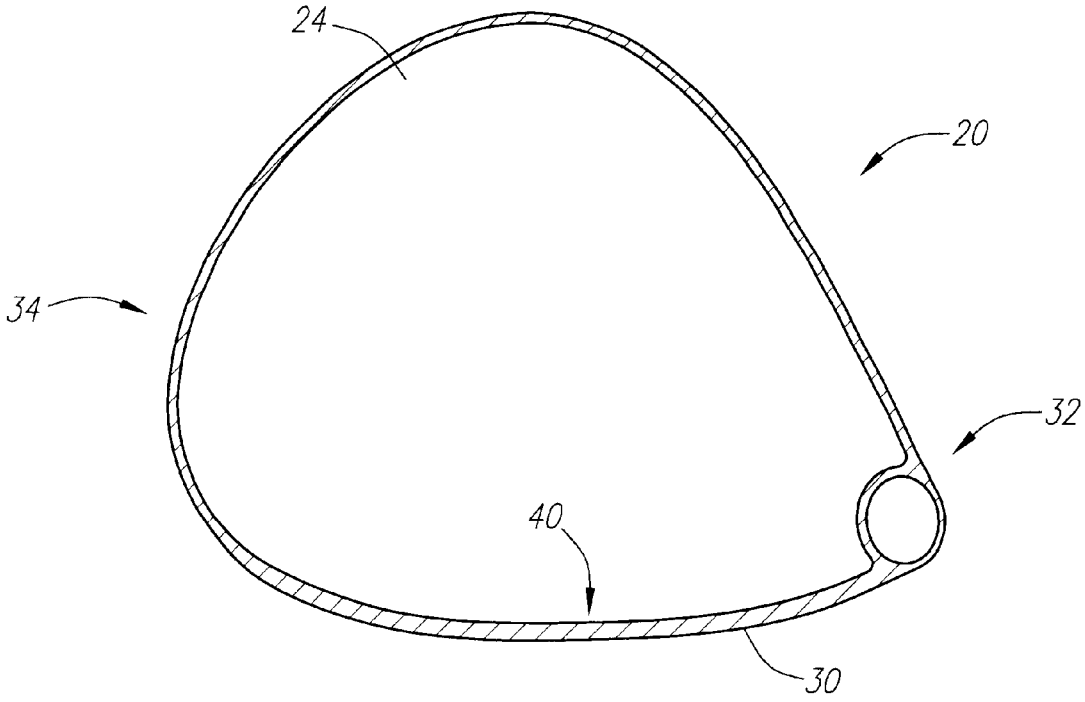
FIG. 4 is a cross-sectional view along lines 4—4 of FIG. 1
Figure 5:
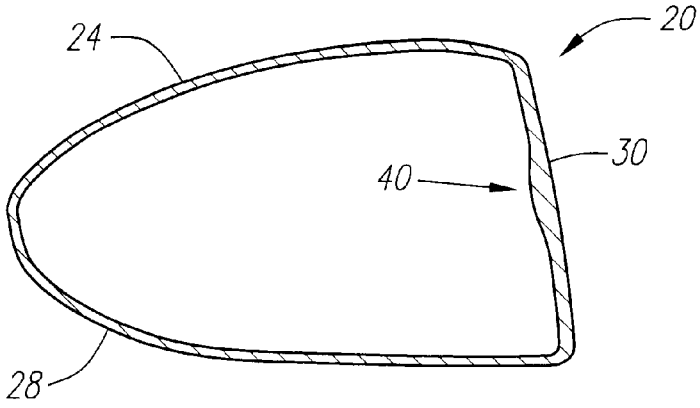
FIG. 5 is a cross-sectional view along lines 5—5 of FIG. 1.

As shown in FIGS. 1–3, a golf club head is generally designated 20. The golf club head 20 has a body 22 with a crown 24, a sole 28, a ribbon 29 and a striking plate 30. The striking plate 30 generally extends from a heel end 32 to a toe end 34 of the front of the golf club head 20. The body 22 has a hosel 36 for receiving the tip end of a shaft, not shown, through an aperture 39.

The striking plate 30 is partitioned into a plurality of elliptical regions 40–46, each having a different thickness or different thickness range. The exterior surface of the striking plate is substantially smooth for impact with a golf ball, while the interior surface of the striking plate varies in thickness creating a non-planar surface that is contoured according to impact probabilities as described in further detail below. A central elliptical region 40 has a base thickness that is preferably the greatest thickness of the elliptical regions 40–46. The base thickness ranges from 0.250 inches to 0.090 inches, preferably from 0.130 inches to 0.110 inches, and is most preferably within the range of 0.122 inches to 0.117 inches. A first concentric elliptical region 42 preferably has the next greatest thickness of the elliptical regions 40–46. The first concentric elliptical region 42 will have a thickness that is less than the base thickness and preferably ranges from 0.117 inches to 0.112 inches. A second concentric elliptical region 44 preferably has the next greatest thickness of the elliptical regions 40–46. The second concentric elliptical region 44 will have a thickness that is less than the first thickness, and preferably ranges from 0.112 inches to 0.100 inches. A third concentric elliptical region 46 preferably is the thinnest region of the elliptical regions 40–6. The third concentric elliptical region 46 has a thickness that preferably ranges from 0.100 inches to 0.085 inches.

Preferably, the concentric elliptical regions 42–46 each have the same width w, although the area of each is different. Further, the elliptical regions 40–46 are preferably angled downward toward the heel end 32 of the sole 28. In a preferred embodiment, the center of each of the elliptical regions 40–46 intersects a plane X perpendicular to a plane Y, as shown in FIG. 1C.

Alternatively, the elliptical regions 40–46 will each have a thickness range of 0.005 inches. For example, the central elliptical region will have a thickness range of 0.120 inches to 0.115 inches, the first concentric elliptical region 42 will have thickness range of 0.115 inches to 0.110 inches, the second concentric elliptical region 44 will have thickness range of 0.110 inches to 0.105 inches, and the third concentric elliptical region 46 will have thickness range of 0.105 inches to 0.100 inches.

Figure 1A:
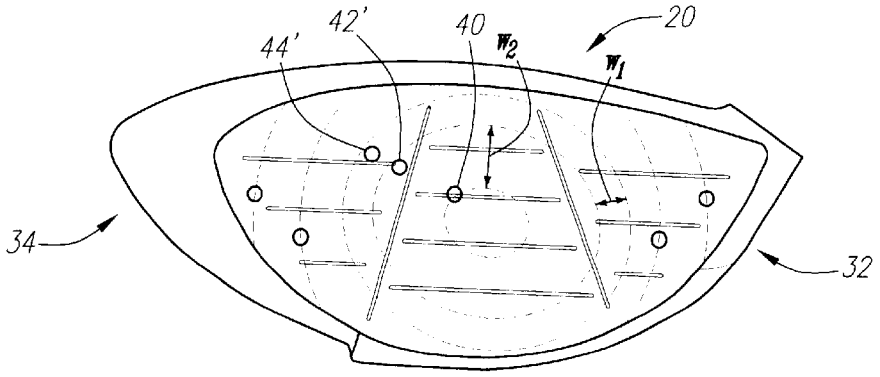
FIG. 1A is a front plan view of an alternative embodiment of the striking plate of the present invention.

FIG. 1A illustrates an alternative embodiment of the present invention wherein the striking plate 30 has only a central elliptical region 40', a first concentric elliptical region 424' and a second concentric elliptical region 44'. In this embodiment, the central elliptical region 40' has a thickness range that is greater than the thickness range of first concentric elliptical region 42', which has a thickness range that is greater than the thickness range of the second concentric elliptical region 44'.

Figure 1B:
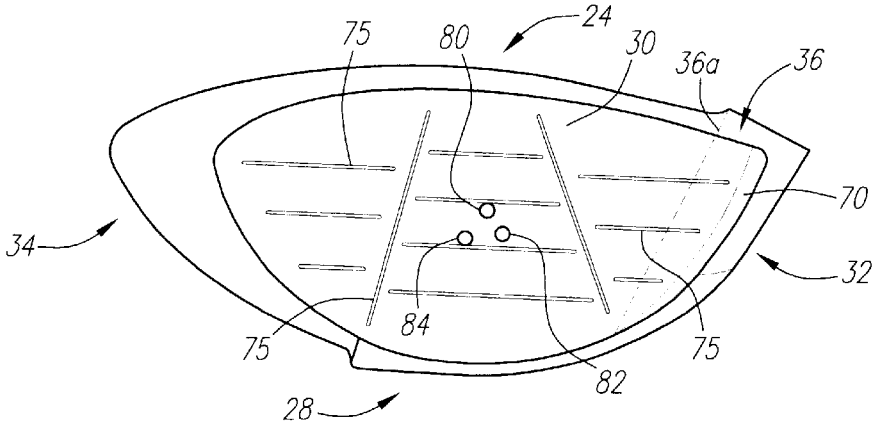
FIG. 1B is a front plan view of the striking plate of the present invention illustrating the geometric center of the striking plate.
Figure 1C:
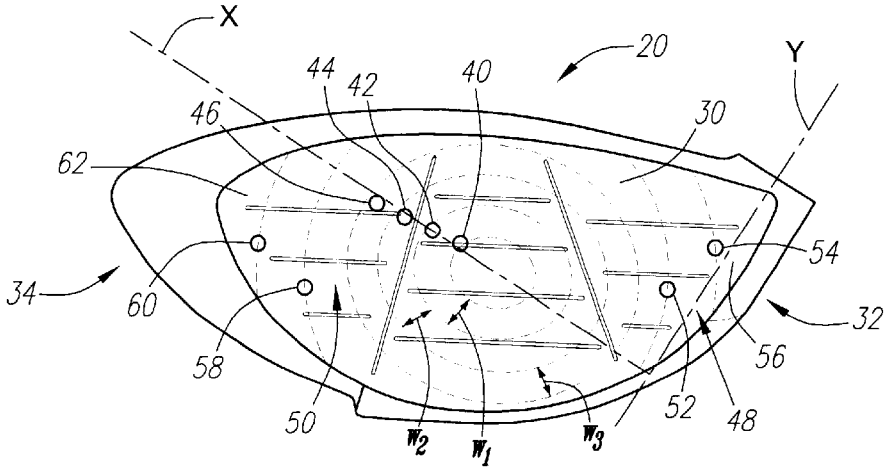
FIG. 1C is a front plan view of the striking plate of the present invention illustrating planes X and Y.

Preferably, the elliptical regions 40–46 extend from the sole 28 to the crown 24. Each of the elliptical regions 40–46 have a circumference 40*a*, 42*a*, 44*a*, and 46*a*, respectively. In the embodiment of FIG. 1, the circumference 46*a* of the third elliptical region 46 extends from the sole 28 to the crown 24 thereby dividing the entirety of the striking plate 30 into a heel region 48 and a toe region 50. Preferably, the heel region 48 is partitioned into a first heel region 52, a second heel region 54 and a third heel region 56. Likewise, the toe region 50 is partitioned into a first toe region 58, a second toe region 60 and a third toe region 62. Preferably, the first heel region 52 and the first toe region 58 have the same thickness range, which preferably is less than the thickness of the third concentric elliptical region 46, and most preferably ranges from 0.085 inches to 0.80 inches. Preferably, the second heel region 54 and the second toe region 60 have the same thickness range, which preferably is less than the thickness of the first heel and toe regions 52 and 58, and most preferably ranges from 0.080 inches to 0.075 inches. The third heel region 56 and the third toe region 62 may have the same thickness range, which may be less than the thickness range of the second heel and toe regions 54 and 60, and may range from 0.075 inches to 0.070 inches. However, in a preferred embodiment, the third heel region 56 is thicker than the third to region 62, and is preferably between 0.070 inches to 0.150 inches. The large variation of the third heel region 56 is due to the hosel 36 that abuts the interior surface of the striking plate at area 70, as shown in FIG. 1B. The hosel 36, outlined by dashed line 36*a*, may abut a greater portion of the interior surface of the striking plate 30 depending on manufacturing requirements.

The striking plate 30 will also have a plurality of scorelines 75 thereon which will effect the thickness of each of the elliptical regions 40–46 at each particular scoreline. A more detailed explanation of the scorelines 75 is set forth in co-pending U.S. patent application Ser. No. 09/431,518, filed on Nov. 1, 1999, entitled Contoured Scorelines For The Face Of A Golf Club, and incorporated by reference in its entirety.

As shown in FIG. 1B, the striking plate 30 has a geometric center 80. The geometric center 80 is found by plotting the geometric center of the entire area of the striking plate 30. The central elliptical region 40 has a geometric center 82 that is offset from the geometric center 80 of the striking plate 30. Additionally, the thickest portion of the central elliptical region 40 is preferably at a point 84, offset from both the geometric center 80 of the striking plate and the geometric center 82 of the central elliptical region 40.

Figure 6:
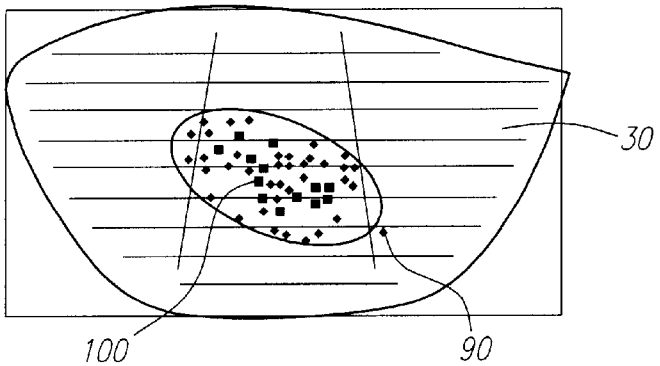
FIG. 6 is an illustration of impact probabilities for high handicap golfers.
Figure 7:
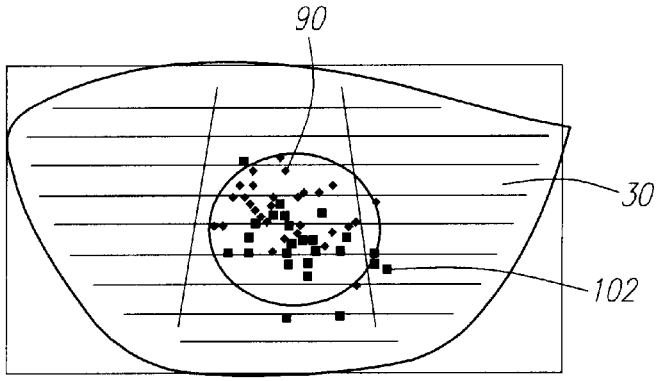
FIG. 7 is an illustration of impact probabilities for low handicap golfers.

As mentioned previously, the thickness of the elliptical regions 40–46, and for the most part, the thickness of the striking plate 30, corresponds to impact probability. FIGS. 6 and 7 illustrate the impact points during a golf swing for high handicap players and low handicap players, respectively. As shown in FIG. 6, the high handicap players had impacts 90 within an elliptical area 100 that extended through the center of the striking plate 30. In comparison, low handicap players had impacts 90 that were more concentrated and within a circular area 102 of the striking plate 30. These impacts 90 illustrate the points on a striking plate 30 that have the highest probability of undergoing the greatest stress during impact with a golf ball. Therefore, these points require greater thickness than other areas of the striking plate 30. Thus, the elliptical regions 40–46 correlate to this impact probability in order to design a striking plate with greater thickness where it is needed instead of in areas low impact probability. The present invention may be described as having heel and toe regions 48 and 50 that are thinner than the central elliptical region 40, or as having elliptical regions 40–46 that are thinner nearer the sole 28 and the crown 24 than at the center of the striking plate 30.

The variation in the thickness of the striking plate 30 also allows for the greatest thickness of elliptical regions 40–46 to be distributed in the center elliptical region 40 of the striking plate 30 thereby enhancing the flexibility of the striking plate 30 which corresponds to greater compliance of the striking plate 30 during impact with a golf ball thereby providing for potentially a greater coefficient of restitution.

Figure 8:
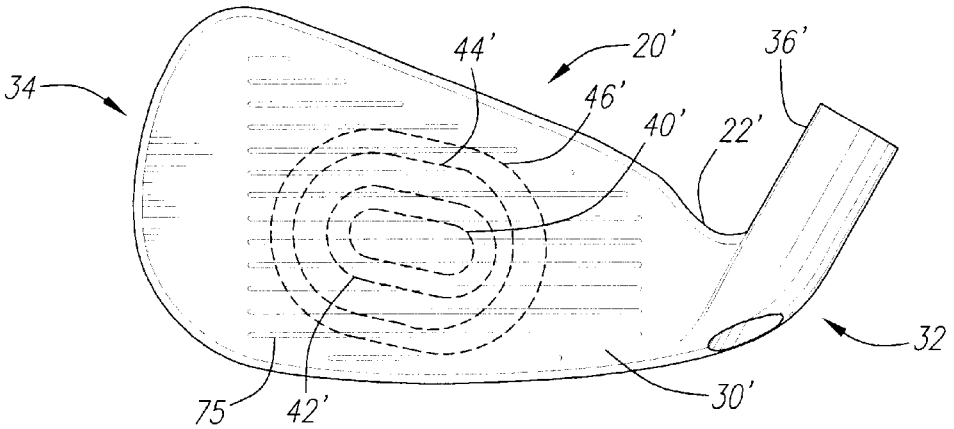
FIG. 8 is a front plan view of an iron golf club head having the striking plate of the present invention thereon.

The striking plate 30 is preferably composed of a stainless steel. Alternatively, the striking plate 30 is composed of a titanium or titanium-alloy material. In yet an alternative embodiment, the striking plate 30,is composed of a vitreous metal such as iron-boron, nickel-copper, nickel-zirconium, nickel-phosphorous, and the like. These vitreous metals allow for the striking plate 30 to have a thickness as thin as 0.055 inches. Preferably, the thinnest portions of such a vitreous metal striking plate would be in the heel and toe regions 48 and 50. Yet in further alternative embodiments, the striking plate 30 is composed of ceramics, composites or other metals. Further, the striking plate 30 may be an insert for a club head 20 such as wood or iron, as shown in FIG. 8. Additionally, the thinnest regions of the striking plate 30 may be as low as 0:0.10 inches allowing for greater compliance and thus a higher coefficient of restitution.

The striking plate 30 of the present invention may be a wood-type, an iron-type or even a putter-type golf club head. FIG. 8 illustrates an iron type golf club head 20'. The golf club head 204' has a body 224' with a striking plate 30. The striking plate 30 has a plurality of scorelines 75 thereon. The iron golf club head 204' also has a hosel 364' for engagement of a shaft therewith. The striking plate 30 has a plurality of elliptical regions 40–46, each having varying thickness as described above in reference to a wood-type golf club head 20.

From the foregoing it is believed that tho&s skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim:

1. A wood-type golf club head comprising:

a body having a crown, a sole, a heel end, a toe end, and a striking plate comprising a central elliptical region having an uniform base thickness ranging from 0.122 inch to 0.117 inch, a first concentric elliptical region encompassing the central elliptical region, the first concentric elliptical region having an uniform first thickness ranging from 0.117 inch to 0.112 inch wherein the base thickness is greater than the first thickness, a second concentric elliptical region having an uniform second thickness ranging from 0.112 inch to 0.100 inch wherein the first thickness is greater than the second thickness, a third concentric region having an uniform third thickness ranging from 0.100 inch to 0.085 inch wherein the second thickness is greater than the third thickness, and a periphery region having a fourth thickness wherein the fourth thickness is less than the third thickness;

wherein the thickness of each of the elliptical regions of the striking plate is assigned according to the probability of impacts with a golf ball wherein the central elliptical region has the highest probability of impacts with a golf ball and is the thickest elliptical region of the elliptical regions of the striking plate.

2. The golf club head according to claim 1 wherein the striking plate is composed of a material selected from the group consisting of titanium, titanium alloys, steels, vitreous metals, ceramics, composites, carbon materials, carbon fiber materials, other fibrous materials and mixtures thereof.

3. The wood-type golf club head according to claim 1 wherein the striking plate further comprises:

a first heel end region and a first toe end region, the first heel end region and the first toe end region each having a fourth thickness range that is less than the third thickness range;

a second heel end region and a second toe end region, the second heel end region and the second toe end region each having a fifth thickness range that is less than the fourth thickness range; and a third heel end region and a third toe end region, the third toe end region having a sixth thickness range that is less than the fifth thickness range and the third heel end region having a seventh thickness range that is greater than the base thickness.

4. The wood-type golf club head according to claim 1 wherein a geometric center of the central elliptical region is different than the geometric center of the striking plate.

5. The wood-type golf club head according to claim 1 wherein the striking plate is composed of titanium.

6. The wood-type golf club head according to claim 1 wherein the striking plate is composed of steel.

7. The wood-type golf club head according to claim 1 wherein the striking plate is composed of an amorphous metal.

8. The wood-type golf club head according to claim 1 wherein the third concentric elliptical region has an elliptical circumference that extends from a sole of the golf club head to a crown of the golf club head.

* * * * *